United States Patent [19]

McStravick

[11] 4,326,585

[45] Apr. 27, 1982

[54] METHOD AND APPARATUS FOR TREATING WELL COMPONENTS WITH A CORROSION INHIBITING FLUID

[75] Inventor: David M. McStravick, Houston, Tex.

[73] Assignee: Baker International Corporation, Orange, Calif.

[21] Appl. No.: 122,224

[22] Filed: Feb. 19, 1980

[51] Int. Cl.[3] ..... E21B 34/08; E21B 37/06

[52] U.S. Cl. ..... 166/244 C; 166/72; 166/188; 166/310; 166/325; 166/328

[58] Field of Search ..... 166/244 C, 249, 310, 166/72, 117.5, 177, 188, 319, 321, 322, 325, 328

[56] References Cited

U.S. PATENT DOCUMENTS

| | | | |
|---|---|---|---|
| 2,290,441 | 7/1942 | McGaffey | 166/177 X |
| 2,293,442 | 8/1942 | Montgomery | 166/310 X |
| 2,654,436 | 10/1953 | Carlisle et al. | 166/310 |
| 2,951,536 | 9/1960 | Garrett | 166/322 X |
| 3,339,635 | 9/1967 | Brandon | 166/249 |
| 3,473,606 | 10/1969 | Page, Jr. | 166/322 X |
| 3,477,507 | 11/1969 | Page, Jr. | 166/322 |
| 3,566,970 | 3/1971 | Crow et al. | 166/310 |
| 3,902,523 | 9/1975 | Guat | 166/321 X |
| 4,031,955 | 6/1977 | Ledet | 166/244 C X |
| 4,066,128 | 1/1978 | Davis et al. | 166/117.5 X |
| 4,132,268 | 1/1979 | Harrison | 166/244 C |

*Primary Examiner*—Stephen J. Novosad
*Assistant Examiner*—George A. Suchfield
*Attorney, Agent, or Firm*—William C. Norvell, Jr.

[57] ABSTRACT

A method and apparatus as provided for periodically supplying a quantity of fluid containing a corrosion inhibitor or other treating fluid to both the internal and external surfaces of downhole components of a subterranean well. The corrosion inhibitor is introduced in the fluid that normally fills the annulus defined between the well casing and the production string. This fluid is periodically subjected to a cyclic pressure and the cyclic pressure is employed to operate valving apparatus disposed in the vicinity of the packer to periodically inject a quantity of the annulus fluid containing the corrosion inhibitor into a bypass passage extending through the packer and, hence, into the production fluid, which the carries the corrosion inhibitor to internally disposed downhole components in the well bore.

14 Claims, 2 Drawing Figures

METHOD AND APPARATUS FOR TREATING WELL COMPONENTS WITH A CORROSION INHIBITING FLUID

BACKGROUND OF THE INVENTION

1. Field of the Invention

The invention relates to a method and apparatus for supplying a corrosion inhibiting fluid to downhole components of a subterranean well.

2. Description of the Prior Art

Downhole metallic apparatuses employed in subterranean wells, such as tubulars, fluid motors, pumps, valves and the like, have long been known to be subject to relatively rapid corrosion due to the corrosive nature of fluids contained in the production fluid produced by certain wells. To minimize the effects of such corrosive fluid, it has been a common practice to periodically treat both the external and internal surfaces of downhole subterranean well components with a corrosion inhibiting fluid, thereby producing a corrosion resistant coating of the metal portions of such components. It is, of course, desirable to effect such corrosion resistant treatment without interrupting the production of the well and, since the internally disposed components are most intimately associated with the corrosive well fluids, it is apparent that the corrosive inhibiting treatment must extend to these internal components. Additionally, it is desirable that the treatment be periodically repeated or continuously provided inasmuch as the flow rates in certain wells could very well effect a removal of a corrosion resistant coating from a metal component in a relatively short time.

SUMMARY OF THE INVENTION

In accordance with this invention, a quantity of corrosion inhibitor fluid is intermingled with a carrier fluid contained in the annulus between the well casing and the production string. A cyclic pressure is applied to such casing fluid by apparatus located at the well head, and a bypass passage is provided in the packer at the bottom of the well. Valving apparatus is provided which is responsive to the cyclic pressure in the corrosion inhibiting casing fluid to periodically inject a portion of the casing fluid into the bypass passage, thereby insuring that adequate quantities of the corrosion inhibitor are periodically introduced into the production fluid and, hence, brought into contact with all internal metal components of the tubing, pumping, valving and similar apparatus disposed in the well. The frequency of application of the corrosion inhibiting fluid and the amount of corrosion inhibiting fluid thus supplied may be conveniently controlled at the well head and the necessity for running an additional tubing line to the bottom of the well is eliminated.

DESCRIPTION OF THE PREFERRED EMBODIMENTS

Figure 1:
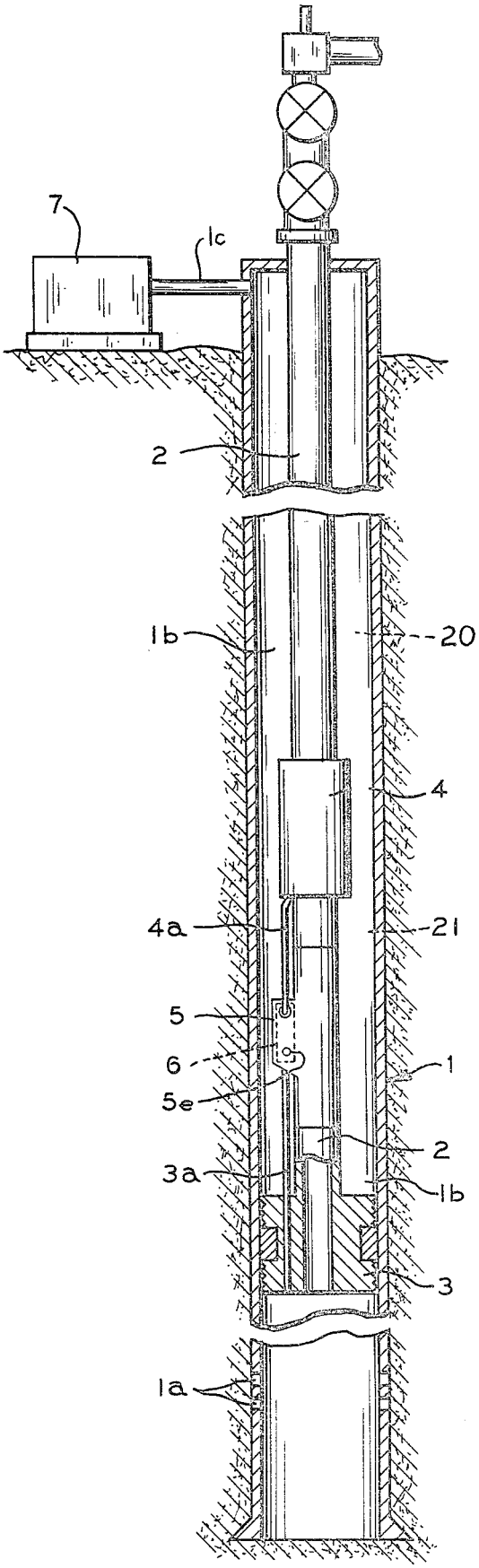
FIG. 1 is a schematic elevational view of the apparatus elements of this invention installed in a subterranean well.

Referring to FIG. 1, numeral 1 schematically represents the casing of a subterranean well having perforations 1*a* adjacent its lower portions which are disposed in the production zone.

A conventional production string 2 is provided within the confines of casing 1 and is secured at its lower end in a conventional packer 3. The casing 1 defines an annular space 1*b* between the interior of the casing wall 1 and the exterior of the production string 2 and, in accordance with this invention, this annulus 1*b* is filled with an inhibited fluid. The annulus fluid is provided with a sufficient quantity of one of a number of well known, commercially available corrosion inhibitors, either in the form of a fluid or a readily dissolvable solid, so that the passage of the corrosion inhibiting containing fluid adjacent to the metal components of the downhole tubulars and equipment will provide adequate protection for such metal components against action of corrosive gases and other fluids sometimes encountered in a subterranean well. It is therefore apparent that all of the external surface portions of the production string 2 and any pumping apparatus disposed within the well casing are provided with corrosion resistant protection by virtue of being surrounded by the corrosion inhibiting containing fluid in the casing annulus.

To provide corrosion protection for the internal components of the downhole apparatus, it is necessary to periodically or continuously introduce quantities of the corrosion inhibiting fluid to the interior of the production string 2. While this can be done at any point along the length of the string, it is obvious that the ultimate in protection would be obtained if the corrosion inhibiting fluid were introduced into the bottom end of the production string. For this reason, a bypass passage 3*a* is provided which is shown schematically extending axially through the packer 3 and, in accordance with the method and apparatus of this invention, a quantity of corrosion inhibiting fluid from the casing annulus is periodically or continuously injected into the space below the packer 3, hence, into the production fluid traveling up through the production string 2 and contacting all internal components associated with such production string.

In the simplest application of this invention, two apparatus elements are required to be inserted in the casing 1 in the vicinity of the packer 3. First is a gas or liquid charged pressure accumulator 4 and the second is a conventional side pocket mandrel 5 which contains valving apparatus 6 constructed in accordance with this invention which is effective to periodically or continuously introduce quantities of corrosion inhibiting fluid from the casing annulus 1*b* through the bypass passage 3*a* to the production fluid entering the production string 2 at the bottom of the well.

In accordance with this invention, the periodic or continuous introduction of a quantity of corrosion inhibiting containing fluid through the packer 3 is accomplished by deriving a pressure signal from a cyclic variation in pressure which is applied to the annulus fluid by a conventional cyclic pressure pump 7 provided at the well head. The casing annulus 1*b* is closed at the well head, as schematically indicated in FIG. 1, thus confining the annulus fluid, and the annulus space is placed in communication with the output of pumping unit 7 by a conduit 1*c*. The surface cyclic pumping unit 7 causes variations in the pressure in the annulus fluid, depending on the well bottom pressure and creates such pressure variations in a cyclic form. In other words, the absolute pressure of the annulus fluid throughout the well, and, particularly at the bottom portion of the well, is varying in a generally sine wave configuration with a variation between the peaks and valleys of the sine wave.

While a number of commercially available pumps may be employed to produce this cyclic pressure variation, I preferably employ a pump of the type described and claimed in the co-pending application Ser. No. 73,335, filed, Sept. 7, 1979, entitled "Pump Assembly Comprising Gas Spring Means", and co-pending application Ser. No. 80,737, filed Oct. 1, 1979, entitled "Apparatus For Pumping Fluid From A Well", each of said co-pending applications being assigned to the same assignee of this present invention.

Figure 2:
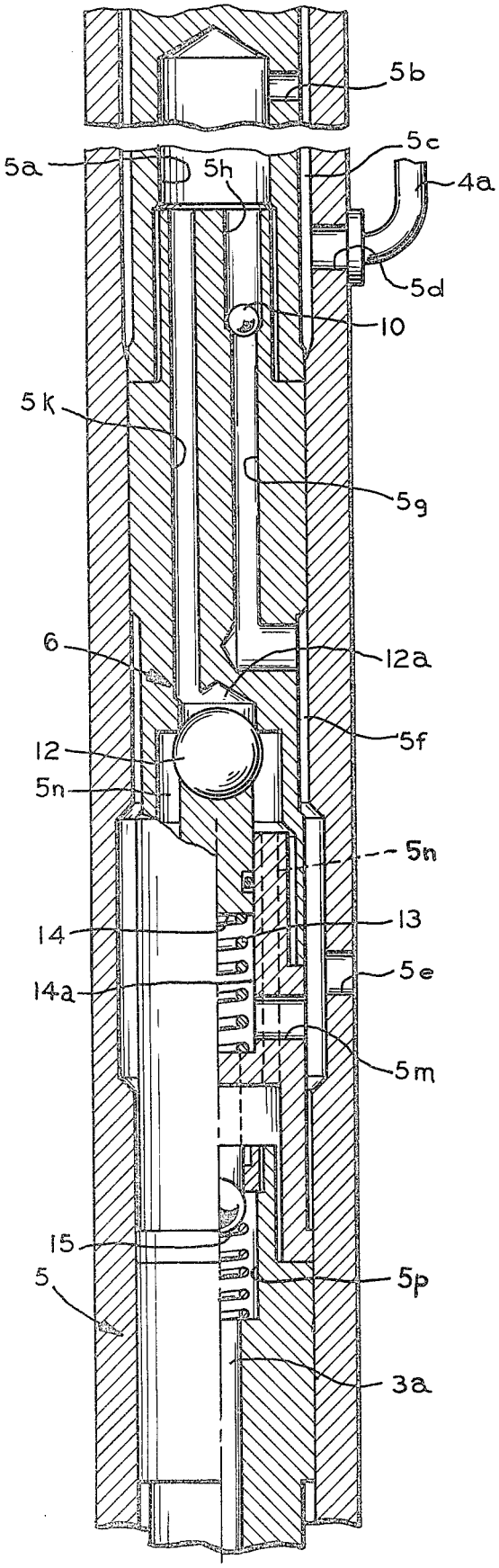
FIG. 2 is a schematic vertical sectional view through the side pocket showing the details of the valving apparatus employed in the apparatus of FIG. 1.

Referring now to FIG. 2, there is shown the details of the apparatus 6 for converting the cyclically varying annulus fluid pressure into a pumping action that will periodically inject a predetermined amount of the corrosion inhibiting containing annulus fluid through the bypass passage 3*a* in the packer 3.

The side pocket mandrel 5 is of conventional configuration and defines a generally cylindrical reservoir chamber 5*a* which is in fluid communication with the pressure accumulator 4. The connection to accumulator 4 is through radial passage 5*b*, axial passage 5*c*, radial passage 5*d* and pipe 4*a*. The internal details of accumulator 4 are not shown because it comprises any conventional form of fluid pressure accumulator involving a confined chamber defined on one side of a movable piston and filled with either a gas or liquid. The annulus fluid is applied to the other side of the shiftable piston by pipe 4*a* and the position of the piston obviously varies as a function of the absolute pressure that the accumulator is exposed to within the well. The function of the accumulator is to absorb or trap excess fluid introduced in the apparatus 6 during the high pressure portions of the cyclic pressure and to return such excess fluid to the apparatus during the low pressure portions of the pressure cycle.

The side pocket mandrel 5 is provided with a radially disposed inlet passage 5*e* which is in direct communication with the corrosion inhibiting pressured fluid contained in the annulus 1*b*. Axially extending passages 5*f* and 5*g* connect the pressured annulus fluid to the normally closed side of a check valve 10 which is disposed in a valve housing 5*h* at the bottom of reservoir 5*a*. As mentioned, reservoir 5*a* is connected to the pressure accumulator 4. Thus, during the high pressure portions of the cyclic variations in the pressure of the annulus fluid, the check valve 10 is unseated to permit a quantity of such fluid to flow into the reservoir 5*a* and from there to flow into the pressure accumulator 4 through the connecting passages 5*b*, 5*c*, 5*d* and tubing 4*a*.

Reservoir 5*a* has one or more axially extending discharge passages 5*k* extending to a chamber 12*a* containing a discharge check valve 12. Check valve 12 is not only urged to its closed position, as illustrated in FIG. 2, by a spring 13 acting on plunger 14, but also is subjected to a pressure bias imposed on a plunger 14 in the cylinder chamber 14*a*, through a radially disposed fluid connection 5*m* communicating with the fluid inlet passage 5*e* of the side pocket mandrel 5.

It is, therefore, apparent that during the increasing pressure portion of the pressure cycle of the annulus fluid, the only effect is to increase the pressure within the accumulator 4, since the spring 13 is effective to maintain the discharge valve 12 in its closed position so long as the annulus fluid pressure is equal to the accumulator pressure.

On the other hand, as soon as the cyclic variation in annulus fluid pressure begins to fall from its peak pressure, the back check valve 10 closes and the trapped peak pressure in the accumulator 4 acts backwardly through tubing 4*a*, reservoir 5*a* and axial passages 5*k* to impose an opening pressure on the discharge valve 12. Since the fluid pressure now exerted by the plunger 14 on the valve 12 has significantly decreased due to the annulus fluid pressure being decreased, the valve 12 may be shifted from its closed position, compressing the spring 13 and permitting the trapped annulus fluid to flow through a plurality of axially extending outlet passages 5*n* which are connected to a check valve chamber 5*p*, which in turn connects externally to pipe 3*a* which extends through the packer 3. Thus, a predetermined quantity of corrosion inhibiting containing fluid is discharged through the bypass passage 3*a* provided in the packer 3 to mingle with the production fluid and, thus, insure that all of the internal components of the production string 2 are exposed to the corrosion inhibiting fluid.

To prevent any inadvertent passage of production fluid upwardly through the bypass passage 3*a*, an additional spring pressed or velocity check valve 15 may be provided in the check valve chamber 5*p*.

It should be noted that the accumulator 4 and the injection control apparatus 6 acts in effect as a slave pump to the surface located pump that is producing the cyclic pressure in the annulus fluid. Moreover, the injection apparatus involving this invention functions substantially independent of the flow rate existing in the production tubing. There are, of course, side pocket mandrels incorporating gas-lift type valves which can produce a flow of annulus fluid into the production tubing; however, these arrangements result in a rapid depletion of the annulus fluid whenever the tubing pressure drops due to a high production flow rate or due more slowly to the natural pressure depletion of the reservoir. Considering the fact that the annulus fluid must contain an adequate quantity of relative expensive corrosion inhibiting materials, the utilization of the corrosion inhibiting annulus fluid in quantities greater than that required to provide adequate corrosion protection, adversely affects the operating economics of the well. Such valve may comprise the sliding sleeve valve incorporated in the side pocket mandrel of U.S. Pat. No. 4,066,128 to Davis, et al.

Although the invention has been described in terms of specified embodiments which are set forth in detail, it should be understood that this is by illustration only, and that the invention is not necessarily limited thereto, since alternative embodiments and operating techniques will become apparent to those skilled in the art in view of the disclosure. Accordingly, modifications are contemplated which can be made without departing from the spirit of the described invention.

What is claimed and desired to be secured by Letters Patent is:

1. Apparatus for injecting a quantity of corrosion inhibitor fluid through a subterranean well, said well having an outer casing, a production string disposed in the casing and defining an annular space within the outer casing, said annular space being filled with a corrosion inhibiting fluid, the apparatus comprising: means for cyclically varying the pressure of said fluid; a fluid pressure accumulator mounted on said production string, said accumulator having a fluid inlet passage communicating with the casing annulus and a fluid outlet passage communicating with the interior of the production string; a first valve preventing fluid passage from said accumulator into said fluid inlet; and a second valve opposing fluid passage from said pressure accumulator into the outlet passage, whereby a quantity of said corrosion inhibiting fluid is only periodically discharged into said outlet passage from said fluid pressure accumulator.

2. The apparatus defined in claim 1 wherein said second valve is urged to a closed position by a piston exposed to said cyclic pressure of said annulus fluid, whereby the discharge of said annulus fluid into said outlet passage occurs during the low pressure portions of said cyclic pressure.

3. The apparatus defined in claim 2 further comprising a third valve disposed intermediate said second valve and the interior of the production string opposing any reverse flow through said outlet passage.

4. In a well having an outer casing, a production string disposed in the casing and defining an annular space within the outer casing, a packer sealingly mounted between the production string and the casing and having a by-pass passage therethrough, said annular space being filled with a corrosion inhibiting fluid, the improvement comprising: means for cyclically varying the pressure of said fluid; a fluid pressure accumulator mounted on said production string above the packer, said accumulator having a fluid inlet passage communicating with the casing annulus, and a fluid outlet passage communicating with said by-pass passage in the packer; a first valve preventing fluid passage from said accumulator into said fluid inlet; and a second valve opposing fluid passage from said pressure accumulator into the outlet passage, whereby a quantity of said corrosion inhibiting fluid is periodically discharged into said by-pass from said fluid pressure accumulator.

5. The apparatus defined in claim 4 wherein said second valve is urged to a closed position by a piston exposed to said cyclic pressure of said fluid, whereby the discharge of said fluid into said by-pass passage occurs during the low pressure portions of said cyclic pressure.

6. Apparatus defined in claim 5 further comprising a third valve disposed intermediate said second valve and the by-pass passage opposing any reverse fluid flow through said by-pass passage.

7. In a subterranean well having a casing, a production string disposed in the casing and defining an annular space within the casing, the bottom portion of said production string being secured in a packer, said packer having a by-pass passage therein, and said annular space being filled with a corrosion inhibiting fluid, the improvement comprising: means for cyclically varying the pressure of said corrosion inhibiting fluid contained in the casing annulus; means communicating between the casing annulus and the production string and responsive to the cyclic pressure variations of said fluid for discharging a limited quantity of said corrosion inhibiting fluid into said by-pass passage in said packer only during the low pressure portions of the cyclic pressure variations of said fluid.

8. The improvement defined in claim 7 wherein said responsive means comprises: a pressure accumulator, said accumulator having a fluid inlet passage communicating with the casing annulus and a fluid outlet passage communicating with said by-pass passage in said packer, a first valve preventing fluid passage from said accumulator into said fluid inlet; and a second valve opposing fluid passage from said pressure accumulator into the outlet passage, whereby a quantity of said corrosion inhibitor fluid is periodically discharged into said by-pass passage from said fluid pressure accumulator.

9. The improvement defined in claim 8 wherein said second valve is urged to a closed position by a piston exposed to said cyclic pressure of said corrosion inhibiting fluid, whereby the discharge of said fluid into said by-pass passage occurs during the low pressure portions of said cyclic pressure.

10. The improvement defined in claim 9 further comprising a third valve disposed intermediate said second valve and the bypass passage in said packer opposing any reverse fluid flow through the packer toward the pressure accumulator.

11. The apparatus defined in claims 1 or 4 further comprising an auxiliary valve disposed in the inlet passage to said accumulator, whereby the closing of said valve prevents the loss of corrosion inhibitor fluid contained in the casing annulus during removal of the valving apparatus.

12. The method of injecting a quantity of corrosion inhibiting fluid through apparatuses in a subterranean well having a production string disposed in a casing and surrounded by an annular space filled with fluid comprising the steps of:

1. inserting a corrosion inhibiting material in the annulus fluid;
2. disposing a valving apparatus between the annular space and the interior of the production string; and
3. applying a cyclically varying pressure to said inhibitor containing fluid; and
4. periodically opening the valving apparatus only in response to the low pressure portions of said cyclic fluid pressure variations to discharge a limited quantity of said inhibitor containing fluid into the production string.

13. The method of claim 12 further comprising the step of disposing an auxiliary valve between the inlet of said valving apparatus and said annular space and closing said valve to permit removal of said valving apparatus from the well without loss of said annulus fluid.

14. The method of injecting a quantity of corrosion inhibitor fluid through apparatuses in a subterranean well having a production string disposed in a casing and surrounded by an annular space filled with fluid, comprising the steps of:

1. inserting a corrosion inhibiting material in the annulus fluid;
2. disposing a valving apparatus between the annular space, an accumulator, and the interior of the production string;
3. applying a cyclically varying pressure to said inhibitor containing fluid;
4. operating the valving apparatus to trap a portion of the inhibitor containing fluid in the accumulator during the high pressure portions of said cyclic fluid pressure variations; and
5. operating the valving apparatus in response to the low pressure portions of said cyclic fluid pressure variations to discharge the trapped quantity of said inhibitor containing fluid into the production string.

* * * * *